United States Patent [19]

Mallen-Herrero et al.

[11] Patent Number: 4,492,541

[45] Date of Patent: Jan. 8, 1985

[54] ROTARY ELECTROHYDRAULIC DEVICE WITH AXIALLY SLIDING VANES

[75] Inventors: Josë Mallen-Herrero, Paris; Daniel Leroy, Limay; Urs Zimmermann, Le Chesnay; Patrice Charlat, Mantes, all of France

[73] Assignee: Compagnie de Construction Mecanique Sulzer, Paris

[21] Appl. No.: 576,798

[22] Filed: Feb. 6, 1984

Related U.S. Application Data

[63] Continuation of Ser. No. 201,935, Oct. 29, 1980, abandoned.

[30] Foreign Application Priority Data

Oct. 30, 1979 [FR] France ..... 79 26873
Jan. 24, 1980 [FR] France ..... 80 01502

[51] Int. Cl.[3] ..... F03C 2/00; F04C 2/00; F04C 15/04

[52] U.S. Cl. ..... 418/23; 418/158; 418/219; 418/231; 188/290; 188/294

[58] Field of Search ..... 418/23, 158, 162, 219, 418/230, 231; 188/290, 293, 294

[56] References Cited

U.S. PATENT DOCUMENTS

| | | | |
|---|---|---|---|
| 905,476 | 12/1908 | Stoehr et al. | 418/219 |
| 1,198,343 | 9/1916 | Gillespie | 418/162 |
| 2,105,712 | 1/1938 | Welch et al. | 188/294 |
| 4,006,804 | 2/1977 | Fehr | 418/158 |

FOREIGN PATENT DOCUMENTS

| | | | |
|---|---|---|---|
| 881308 | 9/1971 | Canada | 418/219 |

*Primary Examiner*—John J. Vrablik
*Attorney, Agent, or Firm*—Karl W. Flocks; Sheridan Neimark; A. Fred Starobin

[57] ABSTRACT

The invention relates to a rotary electrohydraulic device of the volumetrical pump type having stator and rotor as well as vanes axially slidable in said rotor. According to the invention, the intermediary space between the rotor and the stator has an axial longitudinal circulary variable interval partly defined by a continuous stator bottom surface of a constant width, said slidable vanes coming to bear constantly and totally on said continuous bottom surface, which is single for a considered set of said vanes. The device according to the invention is mainly applicable as a brake or slackening means but can also work as a motor and a pump.

2 Claims, 9 Drawing Figures

ROTARY ELECTROHYDRAULIC DEVICE WITH AXIALLY SLIDING VANES

This is a continuation of application Ser. No. 201,935, filed Oct. 29, 1980, now abandoned.

The present invention relates to a rotary electrohydraulic device, mainly applicable as a braking or slackening device but also capable of working as a motor and a pump.

Rotary electrohydraulic brakes are known, consisting of a volumetrical pump having radial vanes and entirely or partly filled with a preferably incompressible fluid, the vanes integral with the rotary member or rotor of the brake being slidable radially in rotor housings and an off-centered cylindrical bore being provided between the stator and the rotor.

In one case, the stator may be in the center and the rotor at the periphery, and in another case, the reverse arrangement may be adopted, i.e. central rotor and peripheral stator.

In both cases, an electromagnetic means to control the brake acts upon the radial sliding motion of the vanes to obtain partitioning of the off-centered cylindrical bore into chambers of different volumes and more or less important lamination of the fluid between vanes and stator through forced circulation of the fluid volumes from one chamber to another.

Centrifugal force acts upon the vanes in a significant way and may even prevent them from running and, depending on the respective arrangement of the stator and rotor and the position of the control member, the action of centrifugal force upon the vanes is exerted either in the direction of the controlled sliding motion or in the reversed direction.

Further devices are known, having axially sliding vanes of a more or less reliable character. In particular, an internal combustion engine may be mentioned, having axial vanes guided between two ramps constituted by strictly parallel curves. The vanes or shuttles slide in an annular rotor having peripheral edges fitted tightly in lateral stator flanges but it is delicate to keep it in working order. Each shuttle being made of two parts comprises inwardly, elastic means working by extension or else, magnetic attraction means can be provided on the parallel ramps.

In a volumetrical pump having axially sliding vanes, cams are provided to draw the vanes in a direction opposed to the action of springs urging the vanes against a planar stator wall. Such retraction motion of the vanes caused by the cams permits them to pass in front of a static separator having an offset contacting plane with respect to the above-mentioned plane, such that on either part of said separator there are provided a fluid inlet and outlet.

In another device, comparable to the previous one, axially sliding vanes having application springs move in a conical annular channel which is interrupted into a projecting circular sector, fluid inlet and outlet orifices being then formed into said sector.

In a further device having axially sliding vanes and application spring the vanes move in at least one channel of a generally circular shape but having variable width and depth, but the machining thereof raises significant problems during fabrication.

The object of this invention is a rotary electrohydraulic device of the volumetrical pump type having axially slidable vanes, wherein the intermediary space between rotor and stator has a circularly variable, longitudinal axial interval, partly defined by a continuous surface of the stator bottom having a constant width, said sliding vanes coming to bear in a constant and total manner on said continuous surface of the bottom which is peculiar to the considered set of vanes.

According to a form of embodiment of this invention, the continuous surface of the stator bottom is a cycloidal surface.

The continuous surface of the stator is a cycloidal surface that can be deformed so as to present rectilinear zones or recesses adapted to the operation of the device.

An electromagnetic control means enables the vanes to bear against the continuous surface of the stator bottom, said control means being disposed behind said surface in a yoke member of magnetic material enclosed in an amagnetic cage of the stator.

According to another form of embodiment, the axially sliding vanes are placed in pairs in rotor housings on either sides of a central stator part, the recesses being opposed back to back on either side of said central stator part and made therein, the vanes approaching each other so as to be applied to the continuous bottom surfaces, with recesses, of said part.

According to still another form of embodiment, a central stator part having bottom surfaces on both sides of a symmetrical axis is made integrally with a fixed shaft part, the rotor being mounted as a cage about the stator.

According to a further form of embodiment, repetitive arrangements about the same (rotary or fixed) shaft are adopted, with separating stator parts having continuous bottom surfaces with deformations or recesses being then possibly provided.

The recesses may have different capacities with one feed means for each pair of opposed recesses.

The device according to the invention can be used as a braking or slackening means, the intermediary space between the rotor and the stator being filled with preferably incompressible fluid.

Said device can also be used as a pump or motor, fluid inlet and outlet lines being then provided to this end.

Other characteristics and advantages of the present invention will appear from the following description in the light of the attached drawings in which.

Figure 1:
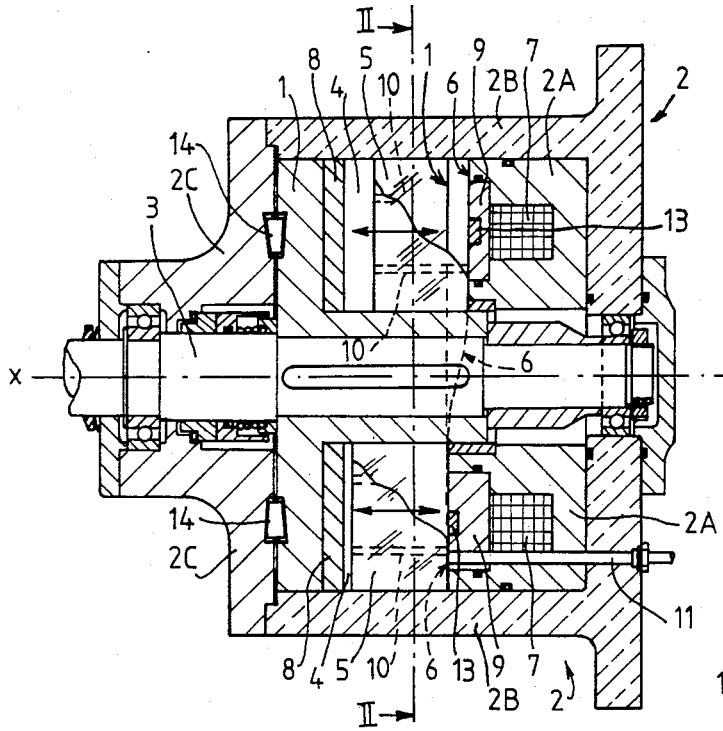
FIG. 1 is a longitudinal section of a rotary electrohydraulic device according the invention.
Figure 3:
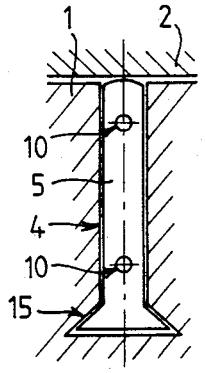
FIG. 3 is a detailed view of another form of embodiment.
Figure 2:
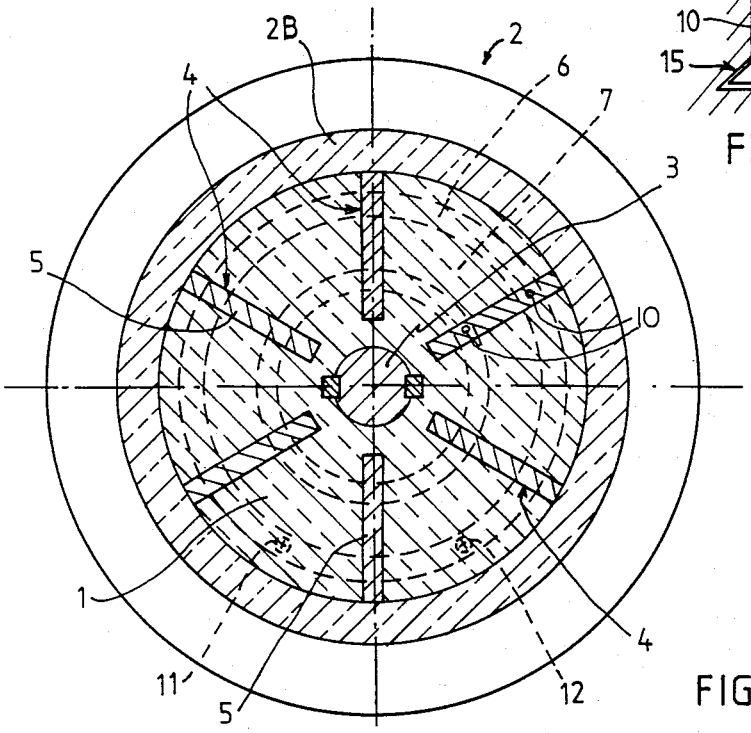
FIG. 2 is a sectional view according to line II—II of FIG. 1.

In the form of embodiment shown on FIGS. 1, 2 and 3, a rotary electrohydraulic device of the volumetrical pump type having sliding vanes according to the invention comprises a rotor 1 and a stator 2.

The rotor which is made integral with a rotary shaft 3 is formed with housings or cavities 4 in which the vanes 5 are mounted.

The vanes lie in a radial position with respect to axis X—X and can move axially along the cavities.

Said vanes and the rotor in which they are housed are disposed within the stator 2 which is characterized in that it comprises a bottom 6 in form of a cycloid. Said stator ensures total tightness and comprises one or more coils 7 that can produce a magnetic field, behind the continuous cycloidal surface of the bottom.

The space between the rotor and the stator is filled with preferably incompressible fluid, such as oil.

In the absence of any control current in the coils 7, in order that the vanes remain within their cavities and the rotor can rotate freely, the vanes can be retained in their cavity under certain conditions of use by means of a permanent magnet 8 or an attraction coil.

Referring to the device according to the invention, when it is used as a brake, the braking operation is produced by acting upon the vanes during production of a magnetic field in the coils. Under these conditions the vanes come to bear on the cycloidal surface so as to create chambers of different volumes in the intermediary space between rotor and stator.

Due to this, fluid enclosed in said chambers produces a torque perpendicular to the vanes thereby resulting into a braking torque on the shaft.

Specifically, it can be noted that the coils 7 are enclosed in a yoke member of a magnetizable material 2A which is itself in, and bolted to, a cage member 2B of a cage made in two parts or elements 2B,2C of the stator, of amagnetic material. The cage with its two parts 2B, 2C also surrounds the rotor made of an amagnetic material, while providing a sealed passageway for the rotary shaft 3.

The axially sliding vanes 5 are made of a magnetizable material and in order that the force lines of the magnetic field produced by the coils 7 may close up through said vanes 5 a crown of an amagnetic material 9 is disposed in the yoke member 2A in front of the coils 7.

The yoke member 2A and the crown 9 permit realization of the continuous cycloidal surface of the bottom 6 of the stator.

Finally, the vanes 5 are traversed by channels 10 for hydraulic balance.

The rotary electrohydraulic device according to the invention can also work as a pump and a motor, and one or more fluid inlet 11 and outlet 12 lines can be provided to this end.

In those embodiments, the cycloidal surface of the stator can be deformed so as to present rectilinear zones suitable for the operation of the device.

Also, in those embodiments, in order to maintain the vanes suitably at any time against the surface of the stator bottom, auxiliary permanent magnets 13 can be provided behind said surface.

According to a form of embodiment, each coil 7 or the coil 7- auxiliary permanent magnets 13 assembly is replaced by a suitable permanent magnet.

It will be understood that whatever the form of embodiment of the device according to the invention, the law of the curve or cycloid realizing the bottom 6 of the stator can be accommodated depending on the desired criteria of execution and functioning.

It must be noted that in all embodiments of the device according to the invention, the action of centrifugal force does not cause lateral mechanical friction of the vanes 5 against a portion of the stator 2, in the occurrence, against the cage member 2B of the stator, and that the frictional condition may be easily improved by procuring an appropriate state of the surface.

According to a form of embodiment, the vane is guided by guiding means 15 formed in the rotor and the friction is related to the position of said guiding means (FIG. 3).

Finally, it must be noted that in all embodiments bearings can be provided, for example, needle bearings 14 between the rotor and the part 2C of the stator to take into account forces exerted by pressurized fluid upon the rotor which then would tend to bear against that part of the stator.

Figure 4:
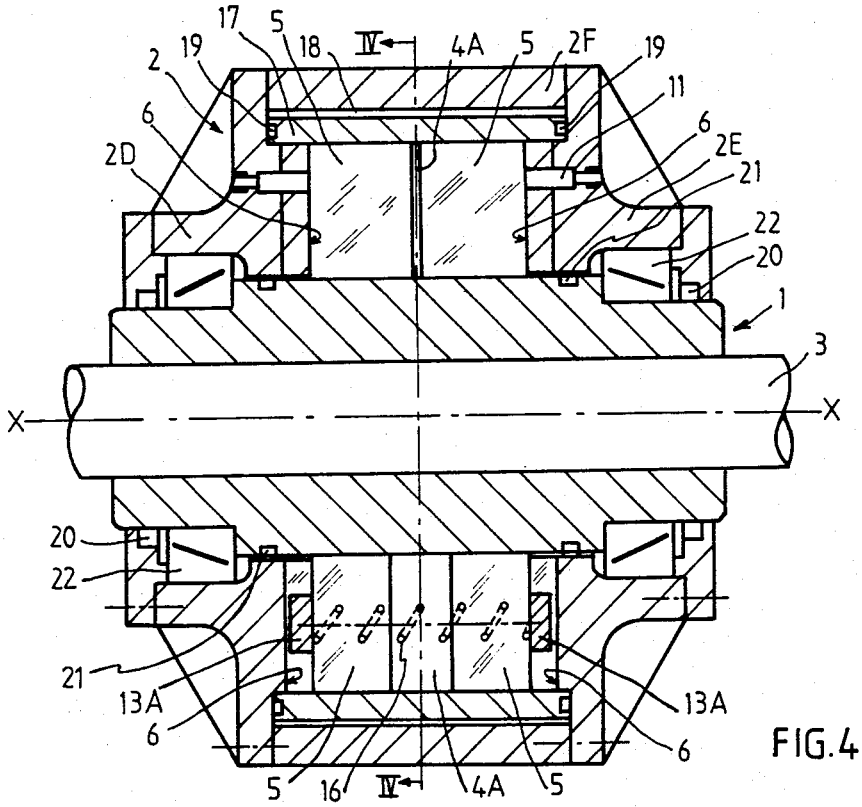
FIG. 4 is a sectional view of a form of embodiment of an electrohydraulic device according to the invention, in which the vanes are mounted in pairs in common housings of the rotor.
Figure 5:
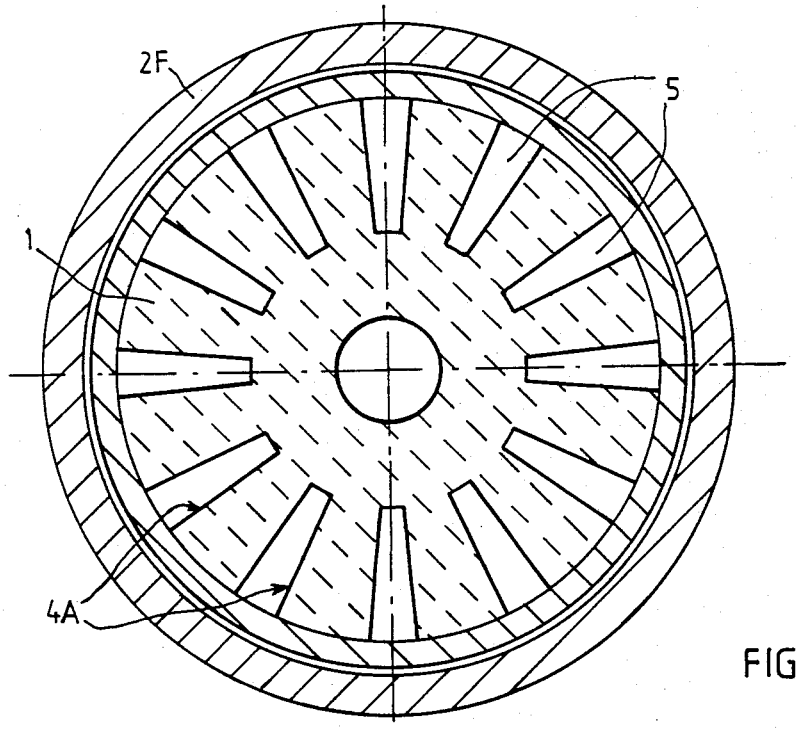
FIG. 5 is asectional view according to line IV—IV of FIG. 4.
Figure 6:
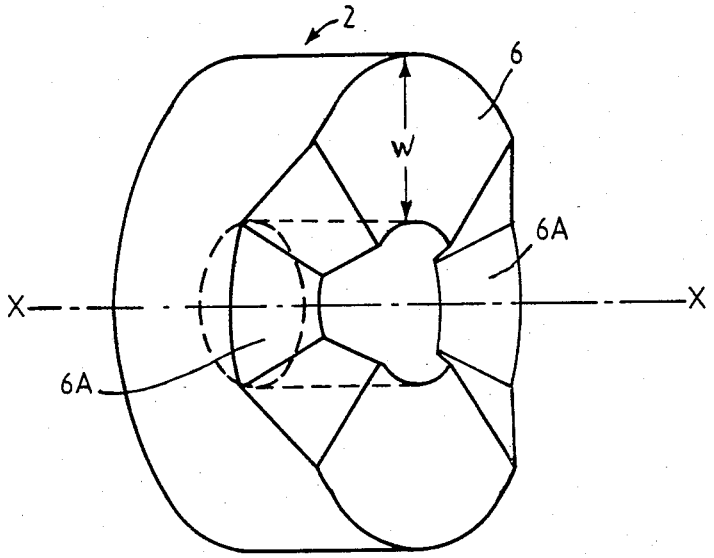
FIG. 6 is a perspective view of a stator element.

In the form of embodiment shown on FIGS. 4 through 6, the sliding vanes 5 having the axial sliding motion are considered in pairs with respect to a symmetrical axis corresponding to the sectional line 11—11 in the housings 4A of the rotor. The vanes in each pair are mounted in one and the same lodging 4A , aligned with one another. The vanes deviate from one another to be applied onto the continuous bottom surface 6 of two stator elements 2D,2E disposed on both sides of rotor 1.

In accordance with the invention, the application force is supplied by electromagnetic control means (coil 7). For simplication purposes, in the form of embodiment shown, the application means are permanent application means, i.e. a permanent magnet 13A for each vane and/or a spring 16, common to both vanes 5 in a pair of vanes, and disposed therebetween.

The permanent magnet is shown by reference numeral 13A, analogously to magnet 13.

The application means may also be hydraulic.

The forces resulting from hydraulic thrusts are statically held back by both elements in the stator 2D, 2E connected to one another by an annular housing 2F in form of a spacer, and in no case do they come to load the bearings of the rotor.

The continuous bottom surfaces 6 of the stator elements having a constant width W may have a variable number of deformations or recesses 6A, having rectilinear zones adapted to the operation. Said number is the same on each stator element. The recesses are opposed face to face and they are supplied in common or simultaneously (11).

The recesses 6A may have different capacities with independent supply for each pair of opposed recesses. The vanes 5 lie in the housings 4A of the rotor which are closed peripherally by a band 17, without friction against fixed elements other than the stator elements 2D,2E.

The band 17 protrudes on both sides of rotor 1 so as to cope with the recesses 6A of the stator elements 2D, 2E the surfaces of which are followed by the sliding vanes. The band 17 is lodged in a space 18 formed by elements 2D, 2E and each of its peripheral edges comprises a seal 19 bearing against one of said elements.

Another sealing device is provided between the rotor and the stator on an outer 20 and inner 21 periphery of the stator. Said sealing device ensures excellent volumetrical yield even at low speed, and the operation may occur with any fluid by insulating the bearing 22 from the rotor.

The vanes 5 are in form of a trapezoidal wedge, with a trapezoidal edge portion of the vanes sliding on one of the continuous surfaces of bottom of the stator elements 2D,2E.

Obviously, the housings 4A receiving the vanes 5 are of a corresponding shape.

Figure 7:
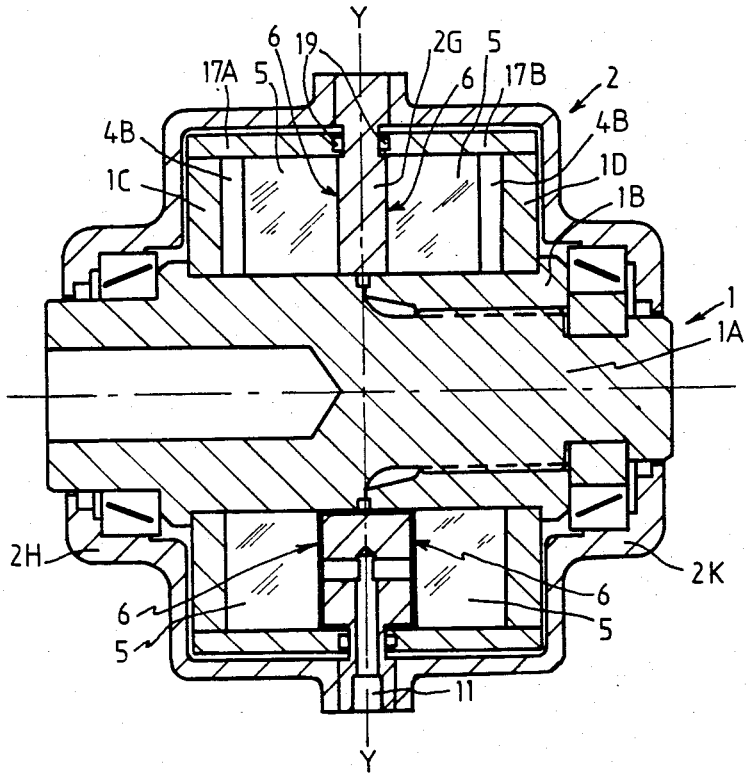
FIG. 7 is a sectional view of another form of embodiment of a device according to the invention in which the vanes are mounted in pairs in aligned housings on either side of a central stator part.

In the form of embodiment shown on FIG. 7, a central stator part 2G carries the continuous bottom surfaces 6 on either side of a symmetrical axis Y—Y.

The sliding vanes having axial sliding motion 5 are mounted in pairs in lodgings 4B arranged in pairs in the rotor 1. The two lodgings of a lodging pair lie in alignment with one another on both sides of the central stator part 2G, hence of the symmetrical axis Y—Y.

The lodgings 4B lying on one side of the central stator part are closed peripherally by a band 17A and lodgings 4B lying on the other side of said central stator part are peripherally closed by another band 17B. Each band has a seal 19 bearing on a central stator part 2G.

The symmetrical arrangement is continued by two stator shells 2H,2K closing on the central stator part 2G and the rotor 1 with its lodgings 4B for the vanes 5 and the bands 17A, 17B closing the lodging 4B.

In this form of embodiment, the stator and the rotor are mounted on the shaft end. For this purpose, to permit its mounting the rotor is realized in at least two main parts 1A,1B screwed into one another. An annular block 1C formed with lodgings 4B connects the band 17A to the portion 1A, and an annular block 1D also formed with lodgings 4B connects the band 17B to the part 1B.

Figure 8:
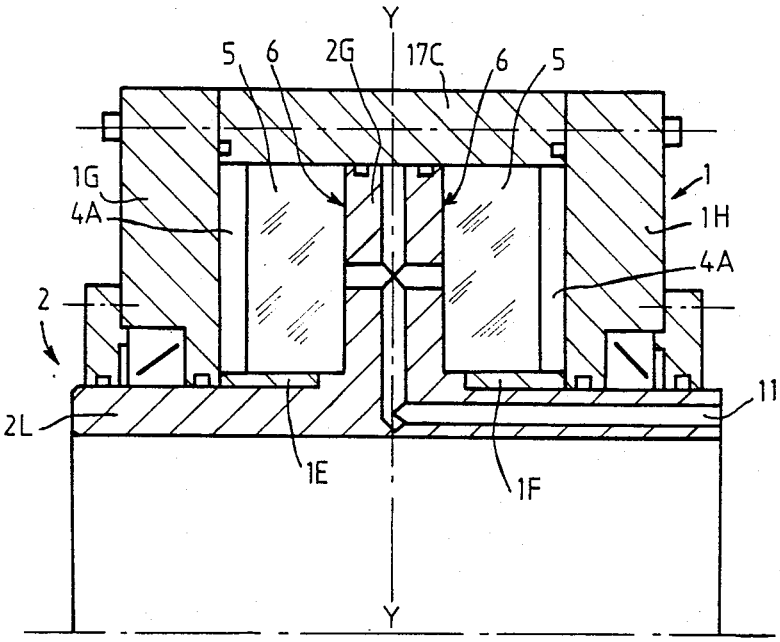
FIG. 8 is a view partly in cross-section of another form of embodiment in which the rotor is in form of a cage.

In the form of embodiment shown on FIG. 8, a central stator part 2G is also provided with bottom surfaces 6 on either part of a symmetrical axis Y—Y, but said central part is made integral with a portion of stationary shaft 2L that may be hollow. The rotor is mounted as a cage about the stator and comprises two central parts 1E, 1F on both sides of the central stator part 2G in which there are formed the lodgings 4A of the lateral flanges 1G, 1H, and a single band in form of a spacer 17C which rotate with vanes 5 mounted slidingly thereon.

Figure 9:
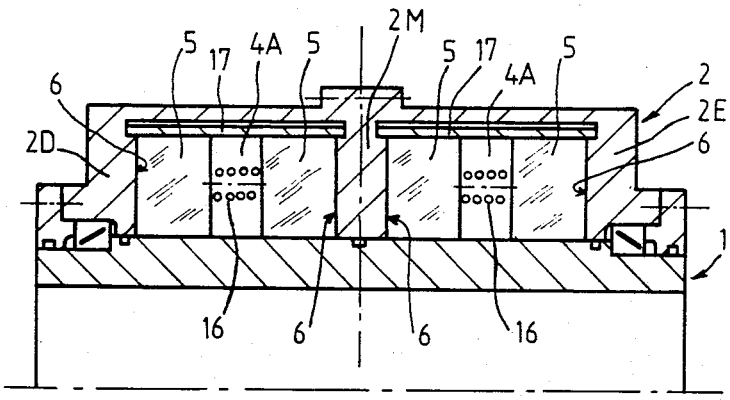
FIG. 9 is a view in partial cross-section of a repetitive arrangement of devices according to the invention about the same shaft.

In all forms of embodiment, repetitive arrangements about the same rotary shaft (FIGS. 4–6 and 7), or about the same stationary shaft (FIG. 8), can be adopted. Thus, an arrangement with at least two rotors, each similar to the rotor of FIG. 4 is shown on FIG. 9.

The two blocks of the rotor formed with lodgings 4A are separated by a stator part 2M to be compared with the stator central part 2G of FIG. 8, and showing continuous bottom surfaces with deformations or recesses 6.

It will be understood that this invention was only described and represented in exemplifying forms of embodiment and that equivalent parts can be substituted for its constitutive elements, without departing from its scope as defined in the appended claims.

We claim:

1. A rotary electrohydraulic device of the volumetrical pump type comprising a stator and a rotor, axially sliding vanes of magnetizable material in said rotor, said stator including a continuous stator bottom surface of a constant width with said vanes bearing constantly and totally on said continuous bottom surface, an amagnetic stator member, a yoke member of magnetizable material in said amagnetic stator member, electromagnetic means located behind said continuous stator bottom surface in said yoke member to control said vanes to enable said vanes to rest on said continuous stator bottom surface during rotation of said rotor, and auxiliary permanent magnet means located beneath said continuous stator bottom surface to assist in maintaining said vanes suitably applied at any moment against said surface.

2. The rotary electrohydraulic device of claim 1, further characterized by an amagnetic crown means located in said yoke member between said electromagnetic means and said continuous stator bottom surface, said auxiliary permanent magnet means located between said continuous stator bottom surface and said amagnetic crown means.

* * * * *